US006152860A

United States Patent [19]

Wang

[11] Patent Number: 6,152,860

[45] Date of Patent: Nov. 28, 2000

[54] MOTOR FOR ELECTRIC JOGGING DEVICE

[76] Inventor: Leao Wang, No 1, Lane 154 Charng Long Rd., Taiping City, Taichung Hsien, Taiwan

[21] Appl. No.: 09/261,752

[22] Filed: Mar. 3, 1999

[51] Int. Cl.[7] ..... A63B 22/00

[52] U.S. Cl. ..... 482/54; 482/51

[58] Field of Search ..... 482/51, 54

[56] References Cited

U.S. PATENT DOCUMENTS

| | | | |
|---|---|---|---|
| 5,141,479 | 8/1992 | Vanjami et al. | 482/54 |
| 5,509,872 | 4/1996 | Chen | 482/54 |
| 5,643,142 | 7/1997 | Salerno et al. | 482/54 |

*Primary Examiner*—Glenn E. Richman
*Attorney, Agent, or Firm*—Dougherty & Troxell

[57] ABSTRACT

A motor for electric jogging device can be outer rotor type motor without brush, outer rotor type motor with brush, inner rotor type motor without brush or inner rotor type motor with brush. A borehole receives a penetrating shaft. In making use of the penetrating shaft, the motors can be fastened on either side of the front or the rear end of the opposite inner side of two side parts of jogging device frames, and one end of each inner (outer) rotor thereof respectively extends outwards to be a roller on which the jogging belt is able to move round in coordination with the other roller. Therefore, when the motor is supplied with power and the rotor is rotated, the roller of the rotor will bring the jogging belt in motion.

8 Claims, 5 Drawing Sheets

MOTOR FOR ELECTRIC JOGGING DEVICE

BACKGROUND OF THE INVENTION

1. Field of the Invention

The present invention relates to a motor for electric jogging device, and more particularly to a motor whose rotor includes a extending roller to directly bring the moving band in motion in order to simplify the motor transmission parts and to reach the more practical value.

2. Description of the Prior Art

The conventional motor for electric jogging device is designed as FIG. 1 shows. The motor 10 is fastened on one side under the frame 21 of the jogging device 20. A rotor axle 11 of the motor 10 is able to transmit a small coaxial gear 12 while the power is transmitted to a greater gear 14 by means of a transmission belt 13. A roller 15 is fastened in the middle of the greater gear 14. When the motor rotates, the said small gear 12, the transmission belt 13 and the greater gear 14 will be therefore brought in motion one after another so that the roller also rotates and furthermore the movement band 22 on the roller is brought in cyclic motion on the same place.

However, this conventional motor 10 is only operable in coordination with the great gear 14, the small gear 12, the transmission belt 13 and the roller 15 so that the assembly of the transmission parts is more complicated and wastes more working time. Moreover, the possibility of malfunction is increased because of the high complexity of the assembly parts.

SUMMARY OF THE INVENTION

It is a main object of the present invention to provide a motor for electric jogging device which can greatly simplify the motor transmission parts and can effectively reduce the malfunction rate of assembly parts.

In order to reach the above object, the present invention includes a rotor which brings the roller in a communicating motion, that is, the roller is one part of the rotor a round which the jogging band can move and which will directly drive the jogging cyclic band.

BRIEF DESCRIPTION OF THE DRAWINGS

The drawings disclose illustrative an embodiment of the present invention which serves to exemplify the various advantages and objects hereof, and are as follows.

DETAILED DESCRIPTION OF THE PREFERRED EMBODIMENT

Figure 1:
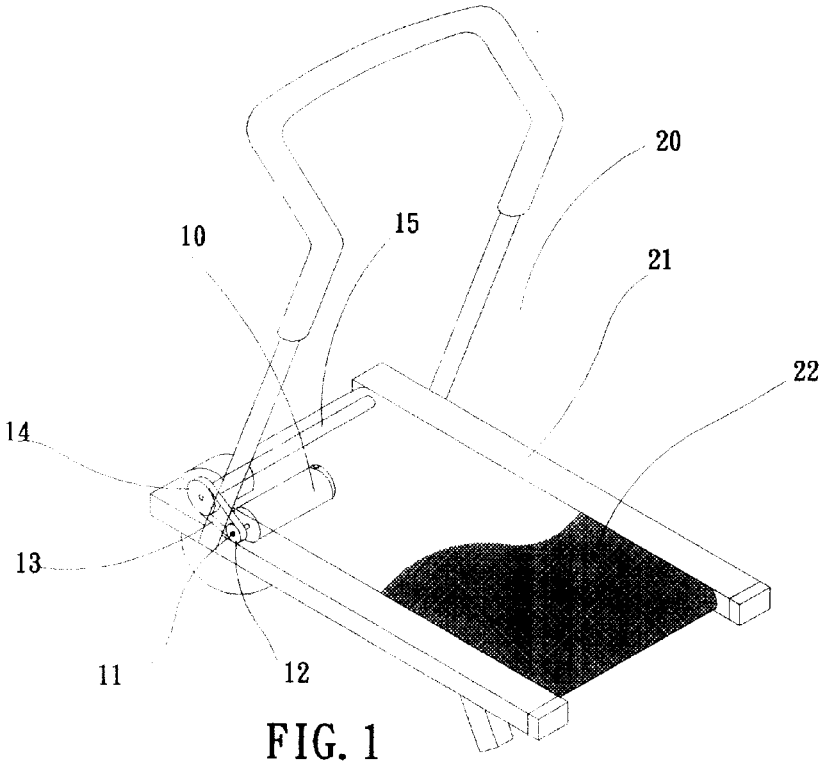
FIG. 1 is a perspective assembly view of the motor and the transmission parts of the conventional electric jogging device.
Figure 2:
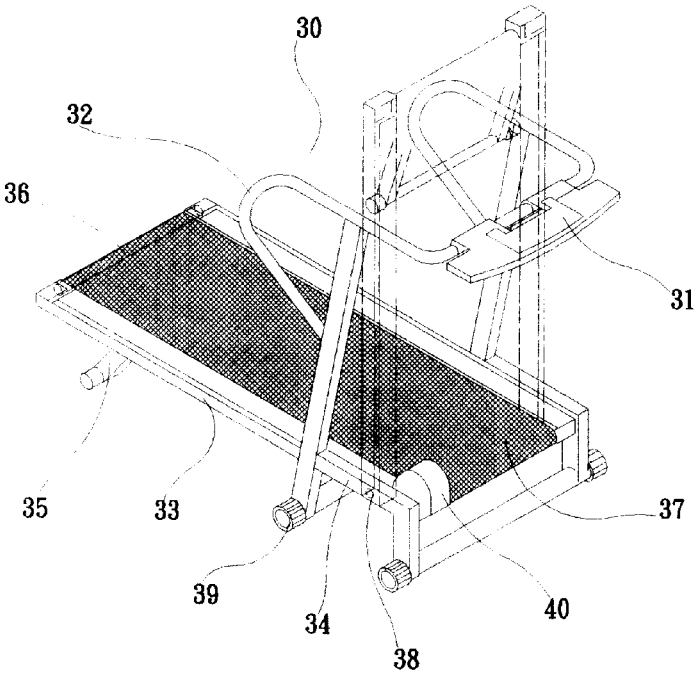
FIG. 2 is a perspective assembly view of a preferred embodiment of the present invention.

First of all, referring to FIG. 2, it shows a preferred embodiment of the motor installed in a jogging device in accordance with the present invention. As shown in FIG. 2, the jogging device 30 includes a straight-standing handle frame 32 which is fitted with an electronic control panel .31 on the front end thereof, a lateral frame 33, a motor transmission mechanism 40, a base 34 and a base backing bar 35, wherein:

- the handle frame 32 is located on the two sides of the front end of the base 34 and upwards extends and moves round;
- the lateral frame 33 has two side frames 331, 332 on which a jogging belt 37 is mounted to circle in coordination with respective rollers 411, 421, 431, 441 of the motors 410, 420, 430, 440 and another roller 36 so that an user is able to make a jogging exercise on the jogging belt 37. On another side, the front end of the lateral frame 33 is able to be turned upwards over in a folding straight-standing position through an axle shaft 38 placed in a proper site of the base 34;
- the motor transmission mechanism 40 whose motors 410, 420, 430, 440 are fastened in coordination with a penetrating shaft 50 on either side of the front or the rear end of the opposite inner side of two side parts 331, 332 of the frames 33, and one end of inner (outer) rotors 412, 422, 432, 442 thereof respectively extends outwards to be rollers 411, 421, 431, 441 which are long enough to reach the other side of the frame 33;
- the base 34 is placed on two sides of the frame 33 near the end of the handle frame 32, and is connected with the frame 33 and pivoted by means of an axle shaft 38, and the sides of the lower end thereof have a ground shaft 39 touching the ground and used to be fixed on a supporting surface;
- the base supporting rod 35 is placed under the rear end of the frame 33 and fixed on a supporting surface, so that a lateral using position is able to formed to support the frame 33.

The motors 410, 420, 430, 440 can be an rotor type motor 410 without brush, outer rotor type motor 420 with brush, inner rotor type motor 430 without brush or inner rotor type motor 440 with brush, and they all are mounted with a power cord (not shown) to be plugged into the power socket (not shown) for power supply.

Figure 3:
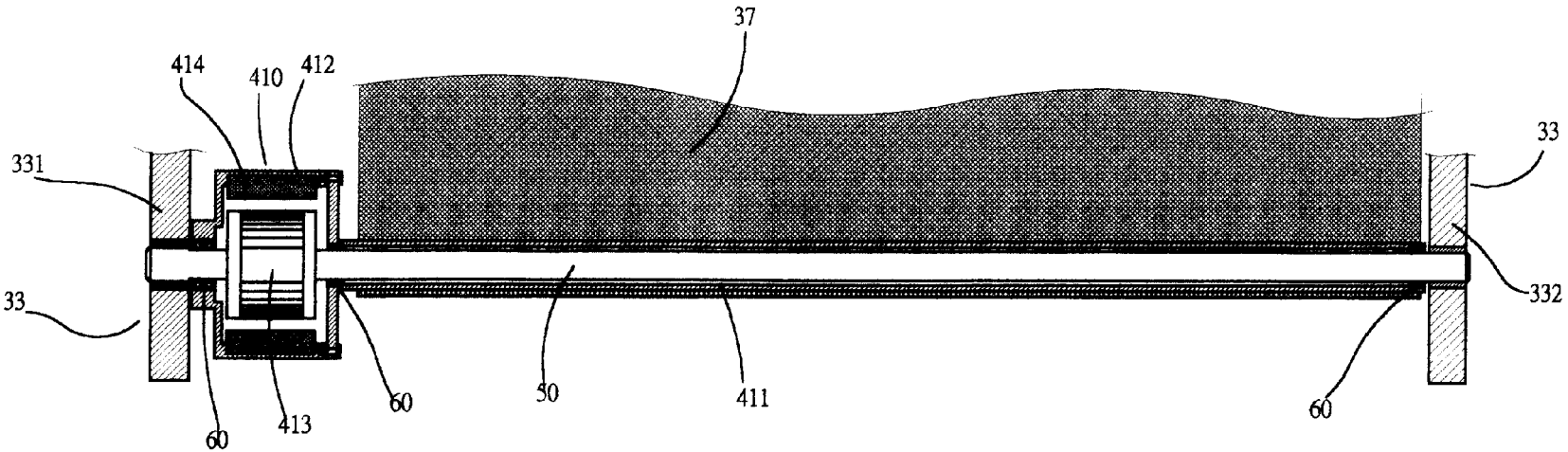
FIG. 3 is a sectional view of a preferred embodiment of the present invention (the outer rotor type motor without brush)

FIG. 3, it illustrates a preferred embodiment of the motor structure being the outer rotor type motor 410 without brush. The motor 410 includes a fixing coil set 413 and an outer rotor 412. A shaft 50 goes through the center of the motor 410 and is fixed on either side of the front or the rear end of the opposite inner side of the two side parts 331, 332 of the frames 333. The area where the outer rotor 412 covers the coil set 413 is wider, so that the coil set 413 is able to be placed inside of the outer rotor 412. An induction magnet 414 is mounted near the edge of the coil set 413 inside of the outer rotor 412. Moreover, the area of the two sides of the outer rotor 412 near the shaft 50 is narrower and longer in order to install a bearing 60 on the respective positions to form a pivoted connection state with the shaft 50. In addition, one end of the outer rotor 412 has a roller 411 extending to the other side of the frame 33, and the roller 411 is long enough to reach the other side of the frame 33 in order to take a concerted rotation with the other roller 36 on the other end of the frame 33 for the jogging belt 37. Therefore, the outer rotor 412 and the roller 411 will be rotated to bring the jogging belt 37 in motion after the motor 410 is supplied with power.

Figure 4:
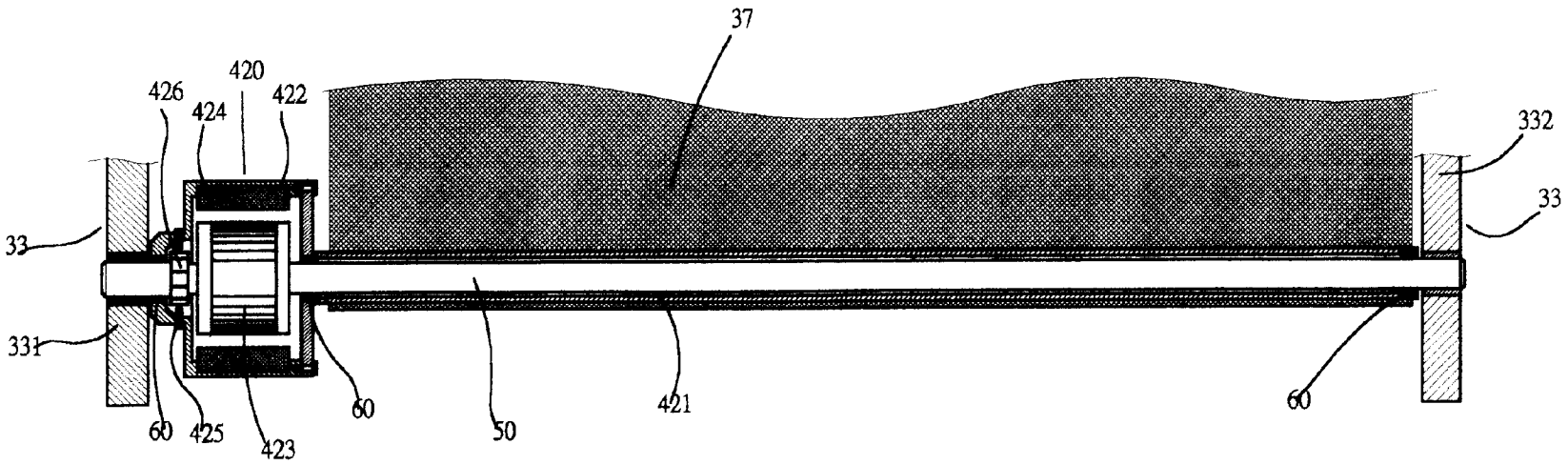
FIG. 4 is a sectional view of another preferred embodiment Of the present invention (the outer rotor type motor with brush)

FIG. 4 illustrates another preferred embodiment of the motor structure being the outer rotor type motor 420 with brush. The motor 420 includes a fixing coil set 423 and an outer rotor 422. A shaft 50 goes through the center of the motor 420 and is fixed on either side of the front or the rear end of the opposite inner side of the two side parts 331, 332 of the frames 33. The area where the outer rotor 422 covers the coil set 423 is wider, so that the coil set 423 is able to be placed inside of the outer rotor 422. An induction magnet 424 is mounted near the edge of the coil set 423 inside of the outer rotor 422. Moreover, the area of the two sides of the outer rotor 422 near the shaft 50 is narrower and longer in order to install a bearing 60 on the respective positions, to form a pivoted connection state with the shaft 50. In addition, one end of the outer rotor 422 has a roller 421 extending to the other side of the frame 33, and the roller 421 is long enough to reach the other side of the frame 33 in order to take a concerted rotation with the other roller 36 on the other end of the frame 33 for the jogging belt 37. A brush set 425 is installed on one side inside of the outer rotor 422 in order to produce an expected effect in coordination with a commutator 426. Therefore, the outer rotor 422 and the roller 421 will be rotated to bring the jogging belt 37 in motion after the motor 420 is supplied with power.

Figure 5:
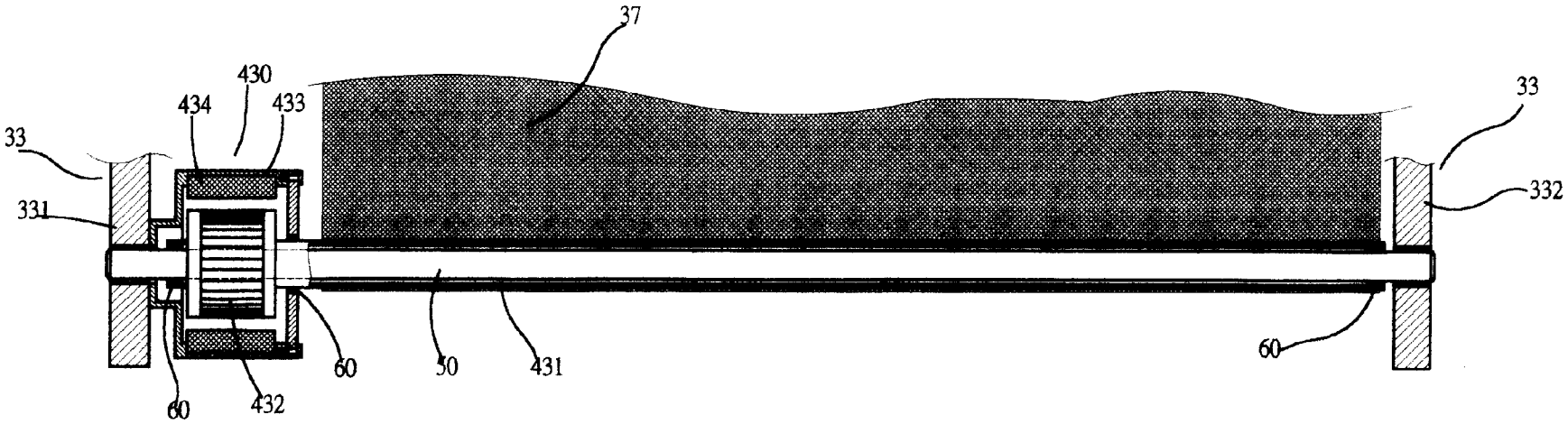
FIG. 5 is a sectional view of a further preferred embodiment of the present invention (the inner rotor type motor without brush)

FIG. 5 illustrates a further preferred embodiment of the motor structure being the inner rotor type motor 430 without brush. The motor 430 includes a fixing magnet set 433 and an inner rotor 432. A shaft 50 goes through the center of the motor 430 and is fixed on either side of the front or the rear end of the opposite inner side of the two side parts 331, 332 of the frames 33. The area where the magnet set 433 covers the inner rotor 432 is wider, so that the inner rotor 432 is able to be placed inside of the magnet set 433. An induction magnet 434 is mounted near the edge of the inner rotor 432 inside of the magnet set 433. Moreover, the area of the two sides of the magnet set 433 is narrower and smaller in order to install a bearing 60 on the respective positions to form a pivoted connection state with the shaft 50 and the roller 431 of the inner rotor 432. In addition, one end of the inner rotor 432 has a roller 431 extending to the other side of the frame 33, and the roller 431 is tong enough to reach the other side of the frame 33 in order to take a concerted rotation with the other roller 36 on the other end of the frame 33 for the jogging cycling belt 37. Therefore, the inner rotor 432 and the roller 431 will be rotated to bring the jogging belt 37 in motion after the motor 430 is supplied with power.

Figure 6:
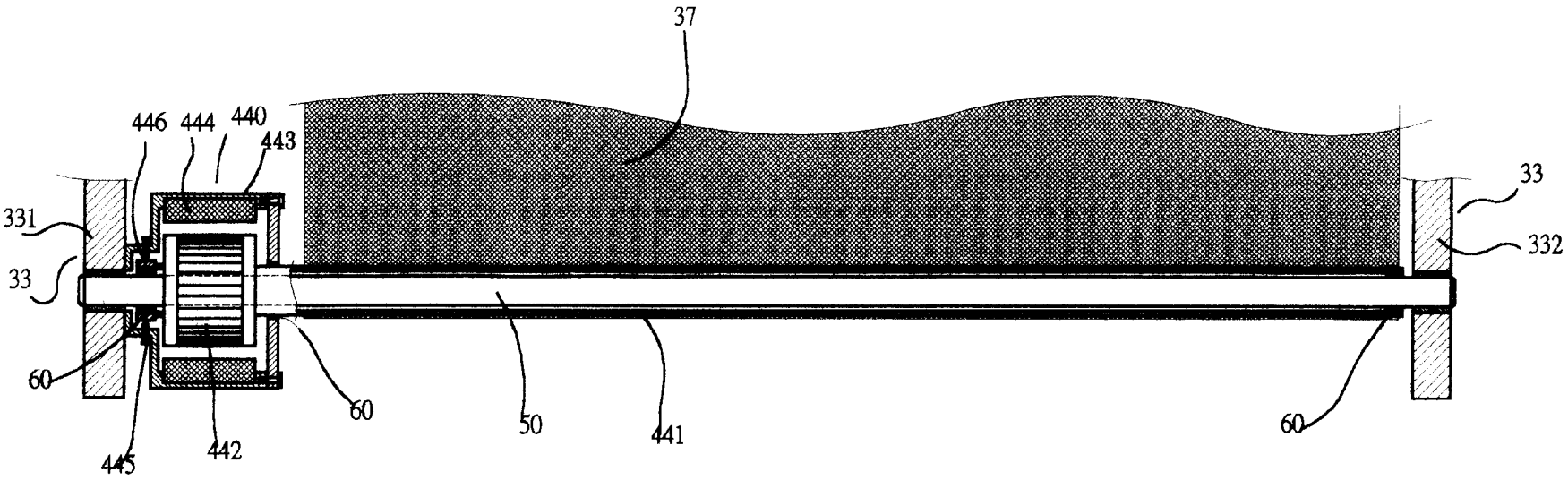
FIG. 6 is a sectional view of still another preferred embodiment of the present invention (the inner rotor type motor with brush).

FIG. 6 illustrates still another preferred embodiment of the motor structure being the inner rotor type motor 440 with brush. The motor 440 includes a fixing magnet set 443 and an inner rotor 442. A shaft 50 goes through the center of the motor 440 and is fixed on either side of the front or the rear end of the opposite inner side of the two side parts 331, 332 of the frames 33. The area where the magnet set 443 covers the inner rotor 442 is wider, so that the inner rotor 442 is able to be placed inside of the magnet set 433. An induction magnet 444 is mounted near the edge of the inner rotor 442 inside of the magnet set 443. Moreover, the area of the two sides of the magnet set 443 is narrower and smaller in order to install a bearing 60 on the respective positions to form a pivoted connection state with the shaft 50 and the roller 441 of the inner rotor 442. In addition, one end of the inner rotor 442 has a roller 441 extending to the other side of the frame 33, and the roller 441 is long enough to reach the other side of the frame 33 in order to take a concerted rotation with the other roller 36 on the other end of the frame 33 for the jogging belt 37. A brush set 446 is installed on one side inside of the inner rotor 442 in order to produce an expected effect in coordination with a commutator 446. Therefore, the outer rotor 442 and the roller 441 will be rotated to bring the jogging cycling belt 37 in motion after the motor 440 is supplied with power.

Since the rotors 412, 422, 432, 442 of the motors 410, 420, 430, 440 extend with the rollers 411, 421, 431, 441 to be a whole body and the diameter of the rotors 412, 422, 432, 442 are obviously greater than that of the rollers, 411, 421, 431, 441, a greater torsion value is able to be obtained to bring the rollers 411, 421, 431, 441 in motion.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A driving system for an electric jogging device having a lateral frame including two side frames, a handle frame, a base attached to the lateral frame and handle frame, and an endless jogging belt movable with respect to the lateral frame, the system comprising:

a) an electric motor having an induction magnet assembly and a coil set, one of the induction magnet assembly and coil set comprising a rotor, the electric motor attached to the two side frames by a shaft connected to the two side frames and to the electric motor; and, b) a roller extending directly from the rotor and rotatably supported on the shaft such that rotation of the rotor causes rotation of the roller, the endless jogging belt passing over the roller, whereby rotation of the roller causes movement of the endless belt.

2. The driving system of claim 1 wherein a diameter of the rotor is greater than a diameter of the roller so that a greater torsion value may be applied to the roller by the rotor.

3. The driving system of claim 1 wherein the electric motor comprises a brushless motor.

4. The driving system of claim 3 wherein the rotor comprises the induction magnet assembly from which the roller directly extends, the roller being rotatably supported on the shaft, the coil set being fixed and mounted on the shaft.

5. The driving system of claim 3 wherein the rotor comprises the coil set from which the roller directly extends, the roller being rotatably supported on the shaft, and the induction magnet assembly is fixed.

6. The driving system of claim 1 wherein the electric motor comprises a brush type electric motor having brushes contacting a commutator.

7. The driving system of claim 6 wherein the rotor comprises the induction magnet assembly from which the roller directly extends, the roller being rotatably supported on the shaft, the coil set being fixed and mounted on the shaft.

8. The driving system of claim 6 wherein the rotor comprises the coil set from which the roller directly extends, the roller being rotatably supported on the shaft, and the induction magnet assembly is fixed.

* * * * *